US005522161A

United States Patent [19]

Vetter

[11] Patent Number: 5,522,161

[45] Date of Patent: Jun. 4, 1996

[54] ARRANGEMENT FOR THE CONTINUOUS HEAT SETTING OF YARNS

[75] Inventor: Gerhard Vetter, Süussen, Germany

[73] Assignee: Micheal Hörauf Maschinenfabrik GmbH & Co. KG, Donzdorf, Germany

[21] Appl. No.: 420,599

[22] Filed: Apr. 12, 1995

[30] Foreign Application Priority Data

Apr. 12, 1994 [DE] Germany ..... 44 12 436.8

[51] Int. Cl.[6] ..... F26B 13/00

[52] U.S. Cl. ..... 34/645; 34/628; 34/648; 68/5 D

[58] Field of Search ..... 34/627, 628, 618, 34/645; 68/5 D, 5 E

[56] References Cited

U.S. PATENT DOCUMENTS

| | | | |
|---|---|---|---|
| 1,820,621 | 8/1931 | Junkers | 34/628 |
| 3,426,553 | 2/1969 | Erb | 68/5 D |
| 3,683,650 | 8/1972 | Hirschburger | 68/5 D |
| 3,899,902 | 8/1975 | Conti | 68/5 D |
| 3,901,053 | 8/1975 | Meisen et al. | 68/5 D |
| 4,316,370 | 2/1982 | Steiner | 68/5 D |
| 4,351,118 | 9/1982 | Von Canon et al. | 68/5 D |
| 4,414,756 | 11/1983 | Simpson et al. | 68/5 D |
| 4,513,514 | 4/1985 | Steiner . | |
| 5,189,810 | 3/1993 | Vetter | 34/618 |
| 5,197,306 | 3/1993 | Yamakita | 68/5 E |

FOREIGN PATENT DOCUMENTS

| | | |
|---|---|---|
| 488995 | 5/1931 | Germany . |
| 1610940 | 4/1966 | Germany . |
| 2747368 | 5/1978 | Germany . |
| 270540 | 1/1930 | Israel . |

*Primary Examiner*—Henry A. Bennet
*Assistant Examiner*—Steve Gravini
*Attorney, Agent, or Firm*—Evenson McKeown Edwards & Lenahan

[57] ABSTRACT

In the case of an arrangement for the continuous heat setting of yarns, which are guided by means of transport belts into, and then out of, a heat setting chamber using superheated steam, at least one central mast is provided which is equipped with several circulating transport belts, arranged in polygonal form when viewed in cross section. At least one yarn is wound around the central mast and the transport belts in controlled loops. The transport belts are themselves subdivided into circulating belt sections, which are arranged consecutively at transfer points, the transfer points being arranged directly upstream and/or downstream of the heat setting chamber.

20 Claims, 5 Drawing Sheets

ARRANGEMENT FOR THE CONTINUOUS HEAT SETTING OF YARNS

BACKGROUND AND SUMMARY OF THE INVENTION

The invention relates to an arrangement for the continuous heat setting of yarns, which are guided by means of transport belts into, and then out of, a heat setting chamber using superheated steam. At least one central mast is provided which is equipped with several circulating transport belts, arranged in a polygonal pattern in cross section. At least one yarn is wound around the central mast and the transport belts in controlled loops.

An arrangement of this kind is disclosed in U.S. Pat. No. 4,513,514. In the case of this known arrangement, the guide pulleys of the transport belts are arranged so far away from the heat setting chamber that the transport belts cool to under 100° Celsius before they enter the heat setting chamber again. The superheated steam in the heat setting chamber can then partly condense onto the transport belts causing damp spots on the transported yarn which then cannot be heat set without imperfections occurring. When a yarn which has not been heat set properly is later dyed, it can result in undesirable color differences or variations.

It is known from the published German patent application 16 10 940 that the complete transport belts including all the guide pulleys and the winding flyer which winds the yarn around the transport belts are arranged inside the heat setting chamber. The disadvantage of this arrangement is that the relevant bearings of the guide pulleys are also heated, which has an adverse effect on their lifetime. It is further known that the transport belts running inside the heat setting chamber are subdivided into several belt sections, which are arranged out of line with respect to each other, so that when the yarn is being transferred from one belt section to the next, the yarn always lies on a different place in order to prevent pressure marks occurring.

It is an object of the invention in the case of an arrangement of the above mentioned type to prevent an unacceptably high level of condensation on the transport belts.

This object is achieved according to preferred embodiments of the invention in that the transport belts are themselves each subdivided into belt sections which are arranged consecutively at transfer points, the transfer points being arranged directly upstream and/or downstream of the heat setting chamber.

As the central mast projects further out of the heat setting chamber on the outgoing side than on the ingoing side, it is frequently sufficient according to certain preferred embodiments of the invention to place a transfer point of two belt sections downstream of the heat setting chamber. The criterion must be hereby observed however that the temperature of the transport belts passing through the heat setting chamber does not fall below 100° Celsius when they leave the heat setting chamber. This criterion is usually met when at least 85% of the travel paths of the transport belts that pass through the heat setting chamber are inside the heat setting chamber. Further preferred embodiments are contemplated for the case of particularly critical yarns, where transfer points are arranged both upstream and downstream of the heat setting chamber.

It is advantageous according to certain preferred embodiments of the invention to provide yarn guiding elements at the transfer points, which arrangement prevents tangling of the yarn loops.

In especially preferred embodiments, double guide pulleys, preferably rubber coated ones, are provided at the transfer points. This results in a simplification of the drive, as the belt sections reaching a transfer point drive the double guide pulleys and therefore also the following belt sections. It is thereby useful when the guide pulley of each double guide pulley on the side towards the central mast is arranged for each successive belt section.

In an advantageous development of certain preferred embodiments of the invention it is provided that at the transfer point, which precedes the heat setting chamber, the guide pulleys have differently sized diameters. The relevant guide pulley of the following belt section preferably has the larger diameter. The transported yarn is, on the one hand, kept taut so that bends or kinks do not occur; on the other hand, the transfer density is reduced dye to the faster speed of the following belt section, which results in a better penetration due to the working climate. This is in particular the case with single high twist yarns or with so-called "SIRO"™ spun yarn, which is not evened out in its ply torque. In the case of folded "BCF"™ yarns it is not necessary to have different pulley diameters. On the contrary, in this case the following belt sections are even let run over smaller diameters so that the yarn can shrink unhindered. The pulley diameters do not need to be different either downstream of the heat setting chamber, as here the heat setting process is already completed.

In a further development of the invention, the cross section circumference of the transport belts, which are arranged in a polygonal pattern, is changeable. On the one hand, the support surfaces of the yarn can be changed, which results in avoidance of pressure marks, while on the other hand the shrinking behavior of the heat set yarn is taken into consideration. A longitudinal rail or a tension wire or similar device can hereby be provided for enlarging the cross section circumference, so that the yarns do not hang through between two transport belts. This is particularly advisable in the case of polyester yarns.

Inside the heat setting chamber it is convenient according to certain preferred embodiments of the invention to have the yarn loops carried only by two upper transport belts. The lower transport belts are guided by suitable guiding means away from the loops and slightly towards the inside so that the loops can hang freely downwards. Experience has shown that pressure marks which hamper the heat setting are thus avoided. However, the loops must be guided by all transport belts again before reaching the next transfer point.

The loops, hanging freely downwards, are advantageously stretched outwards by rust-free tension wires or similar devices according to certain preferred embodiments. These tension wires should be capable of being adjusted in their positions to adapt to shrinkage.

As the round transport belts which are usually used can rotate around their own axis, which can lead to random orientation of the loops, it is intended in a further development of the invention to use round, but softer transport belts. These are pressed flat during operation and are therefore incapable of rotating.

In order to reduce even further the condensation build-up in the heat setting chamber, the transport belts can be made as wire cords according to certain preferred embodiments of the invention. These have the advantage that they practically cannot absorb any dampness internally.

Other objects, advantages and novel features of the present invention will become apparent from the following detailed description of the invention when considered in conjunction with the accompanying drawings.

DETAILED DESCRIPTION OF THE DRAWINGS

Figure 1:
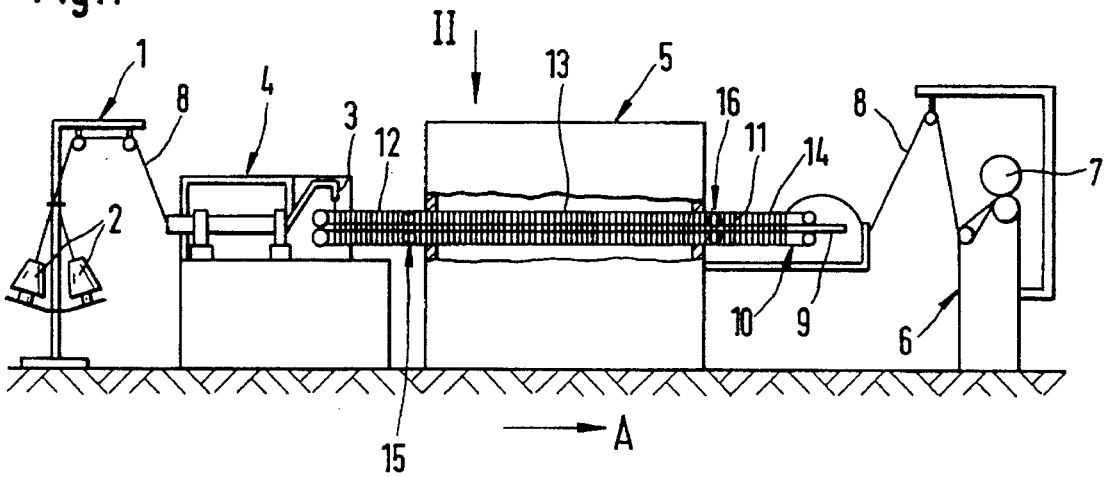
FIG. 1 is a side schematic view of an entire installation for the continuous heat setting of yarns constructed according to preferred embodiments of the invention.

The arrangement according to the invention contained in the installation consists mainly of a supply creel 1 for feeder packages 2, a winding machine 4 comprising several winding flyers 3, a heat setting chamber 5 as well as a take-up winder 6 for winding packages 7. Such an installation is, in its basic construction, prior art.

Figure 2:
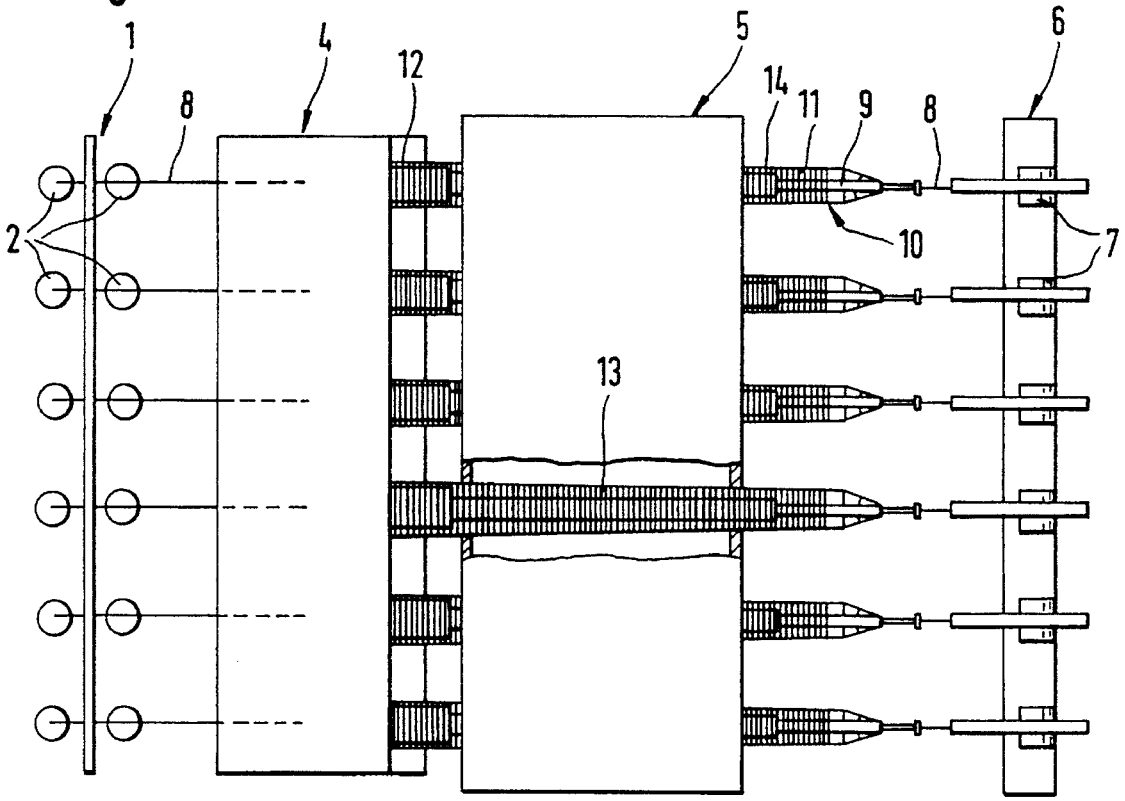
FIG. 2 is a top view of the installation of FIG. 1, taken in the direction of the arrow II.

The yarns 8 to be treated are transported through the installation in arrow direction A. A so-called central mast 9 is supported in the winding machine 4, and projects cantilever-wise through the heat setting chamber 5. According to FIG. 2, six central masts 9 are provided. Each central mast 9 is equipped (in a way which will be described in more detail later) with four transport belts 10 in total, which are arranged in a polygonal pattern when viewed in cross section (this will also be described later). The individual winding flyers 3 each wind a yarn 8 or several yarns in a known way in controlled loops 11 around the central mast 9 and the transport belts 10.

The transport belts 10 undergo a forward feed, whereby the so-called winding density of the yarns 8 results from the relationship of the speed of the transport belts 10 and the rotational speed of the winding flyers 3.

The heat setting chamber 5 works in a so-called open system in atmospheric pressure with superheated steam. When the circulating transport belts 10 leave the heat setting chamber 5 shortly on the outgoing side as well as on the ingoing side, there is a danger that the transport belts 10 will cool down to under 100° Celsius. The transport belts 10 must then be re-heated by the superheated steam when they re-enter the heat setting chamber 5. Condensation thus builds up, which is then absorbed by the yarns 8 on the respective supporting surface. The yarns 8 then contain damp spots, which cannot achieve the heat setting temperature in the relatively short dwell time so that the yarns 8 do not receive adequate heat setting. The result of this can be seen for example in a later dyeing process where color differences occur.

According to the invention it is intended that the transport belts 10 are subdivided into circulating belt sections 12, 13 and 14, which are preferably arranged in succession at transfer points 15 and 16, the transfer points being arranged directly upstream and downstream of the heat setting chamber 5. The lay-out is such that a belt section 12 is arranged upstream of the heat setting chamber 5 and completely outside of same, while a belt section 14 is arranged downstream of the heat setting chamber 5 and is also completely outside of same. This has the advantage that the individual winding flyers 3 and all the guide pulleys are outside of the heat setting chamber 5. The middle belt section 13 on the other hand runs through the heat setting chamber 5. The guide pulleys of the middle belt section 13 are indeed outside of the heat setting chamber 5, but at least 85% of the belt section 13 is always inside the heat setting chamber 5, which means that the belt section 13 does not cool down under 100° Celsius. The belt section 13, which runs predominantly in the treatment medium, retains its temperature so that no condensation, which could lead to imperfections in the treatment, occurs inside the heat setting chamber 5 on the transport belts 10.

Because in the case of working installations the individual central masts 9 project further out on the outgoing side of the heat setting chamber 5 than on the ingoing side, it is often sufficient to provide a transfer point 16 for the transport belts 10 directly downstream of the heat setting chamber 5. Such a transfer point 16 will be described with the aid of FIGS. 3, 4 and 5, whereby the drawing reference characters already used will be continued. It should also be noted that for diagrammatical reasons some components have been left out in FIG. 5, and only the area on one side of the longitudinal middle plane 17 (FIG. 4) of the installation is depicted in FIG. 5.

Figure 3:
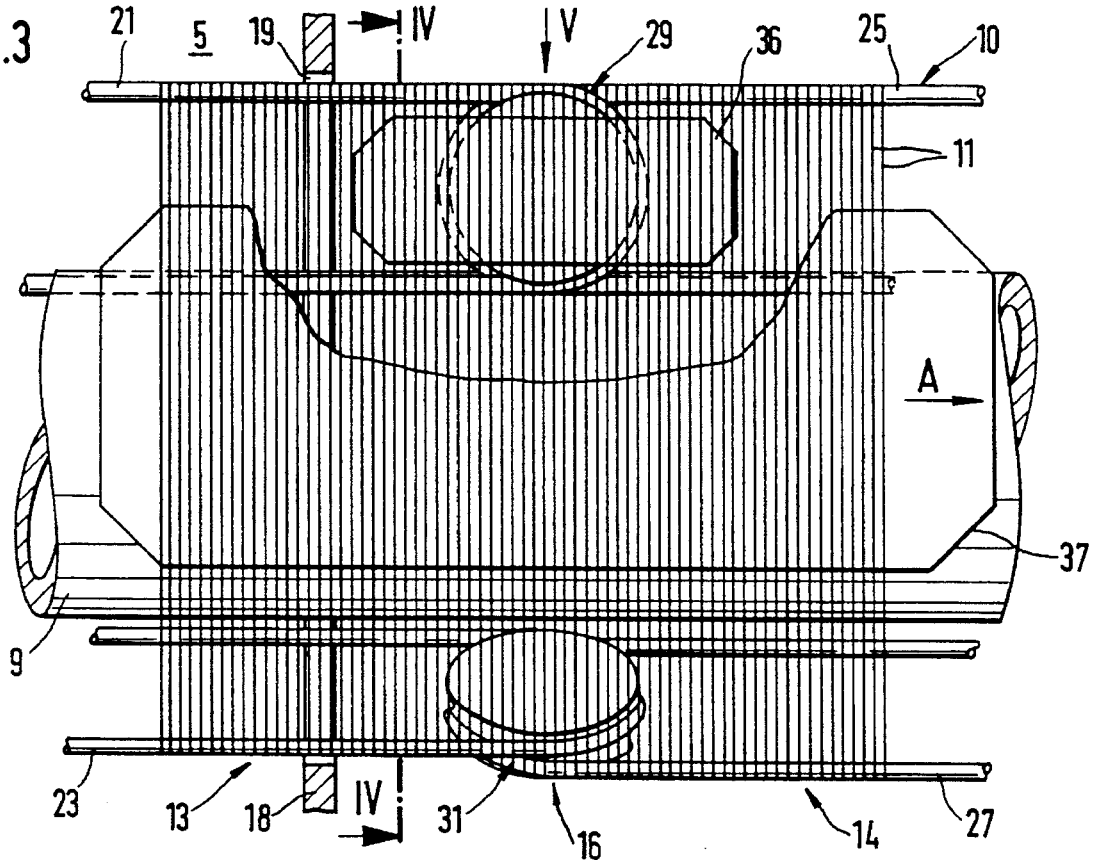
FIG. 3 shows a greatly enlarged partial view of FIG. 1 in the area of the outgoing end of the heat setting chamber.
Figure 5:
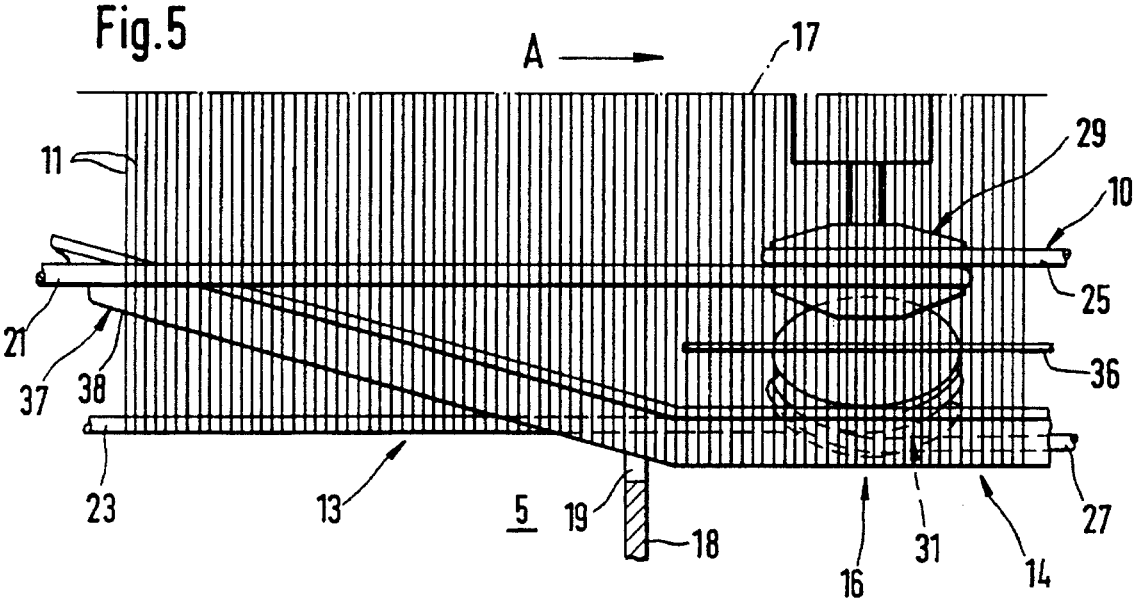
FIG. 5 shows a partial view taken in the direction of the arrow V of FIG. 3.

The boundary wall of the heat setting chamber 5 on the outgoing side has the reference numeral 18, so that in FIGS. 3 and 5 the heat setting chamber 5 is left of the boundary wall 18. The boundary wall 18 leaves an entry opening 19 which provides free access for a central mast 9, the transport belts 10 arranged at the mast 9, and the loops 11 of the yarns 8 wound around the belts 10.

Figure 4:
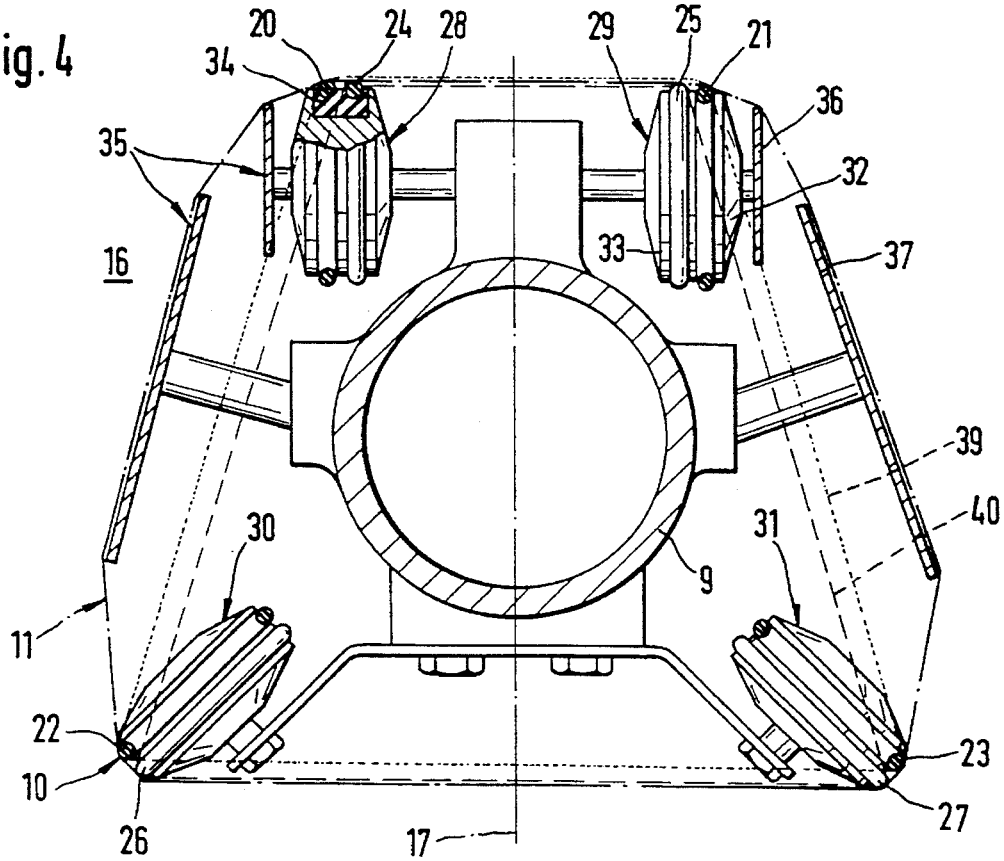
FIG. 4 shows a cross sectional view along the section line IV—IV of FIG. 3.

The transfer point 16 simultaneously forms the end of the belt section 13 arranged to travel through the heat setting chamber 5 and the beginning of the next belt section 14. The belt section 13 comprises four single belts 20, 21, 22 and 23 altogether, each for example with a round cross section, whereby the single belts 20 to 23 are arranged in a trapezoidal or rectangular shape pattern when viewed in cross-section. In FIGS. 3 and 5 however, only the two single belts 21 and 23 are visible. Accordingly, the following belt section 14 also comprises four single belts 24, 25, 26 and 27, which are also round and also, when viewed in cross section of the central mast 9, arranged in a trapezoidal pattern form. These will become more recognizable later with the aid of FIGS. 7 and 8. In FIGS. 3 and 5 only the single belts 25 and 27 are visible. Only FIG. 4 shows all single belts 20 to 27 of both belt sections 13 and 14.

Four double guide pulleys 28, 29 30 and 31 are arranged at the transfer point 16. The double guide pulley 28 belongs to the single belts 20 and 24; the double guide pulley 29 belongs to the single belts 21 and 25; the double guide pulley 30 belongs to the single belts 22 and 26, and the double guide pulley 31 belongs to the single belts 23 and 27. Each of the double guide pulleys 28 to 31 comprises two guide pulleys 32 and 33 which are fixedly connected to each other (see FIG. 4), whereby the guide pulley 33, on the side towards the central mast 9 of each double guide pulley 28 to 31 is arranged to the guide belt section 14 which succeeds the belt section 13. The loops 11 of the yarns 8 are deposited at the transfer point 16 from a larger cross section to a smaller one.

The double guide pulleys 28 to 31 are provided with a rubber coating at those points where they guide the single belts 20 to 27.

The individual double guide pulleys 28 to 31 are each supported either directly or indirectly by the horizontally arranged central mast 9. The two upper double guide pulleys 28 and 29 are arranged nearer to each other than the two lower double guide pulleys 30 and 31. The two lower double guide pulleys 30 and 31 are also inclined with their axles at an angle of about 45° to the horizontal plane, so that the loops 11 can be guided in an orderly way within the belt sections 13 and 14.

Yarn guiding elements 35 (FIG. 4) are allocated to the transfer point 16 which ensure that the loops 11 of the yarns 8 do not tangle when transferring from belt section 13 to belt section 14. These yarn guiding elements 35 comprise per central mast side an upper guiding plate 36 and a lower guiding plate 37. The upper guiding plates 36 are arranged in a stationary position at the outer front sides of the respective double guide pulleys 28 and 29. Each lower guiding plate 37 is supported in a stationary position at the central mast 9, once between the two double guide pulleys 28 and 30 shown on the left in FIG. 4 and once between the two double guide pulleys 29 and 31 shown on the right in FIG. 4. The lower guiding plates 37 are located so far outwards that the loops 11 of the yarns 8 can be transferred without any problems occurring at the transfer point 16 from the belt section 13 onto the belt section 14. A loop 11 at the moment of transfer is shown in FIG. 4 by the dot-dash line.

As can be seen in particular from FIG. 5, the lower guiding plates 37 have a leading-in slant 38, so that the loops 11 transported with the belt section 13 can be guided onto the yarn guiding elements 35.

In FIG. 4 another loop 39, represented by a dotted line, and a loop 40, represented by a broken line, are shown. The dotted course shows the position of the loops 39 as they arrive with the belt section 13 before reaching the yarn guiding elements 35. The broken line shows on the other hand how the loops 40, after having left the yarn guiding elements 35, are transported onwards in the belt section 14. The circumferential enlargement which then takes place can be achieved by the elastic malleability of the yarns 8, as the transfer point 16 is already downstream of the heat setting chamber 5.

Figure 6:
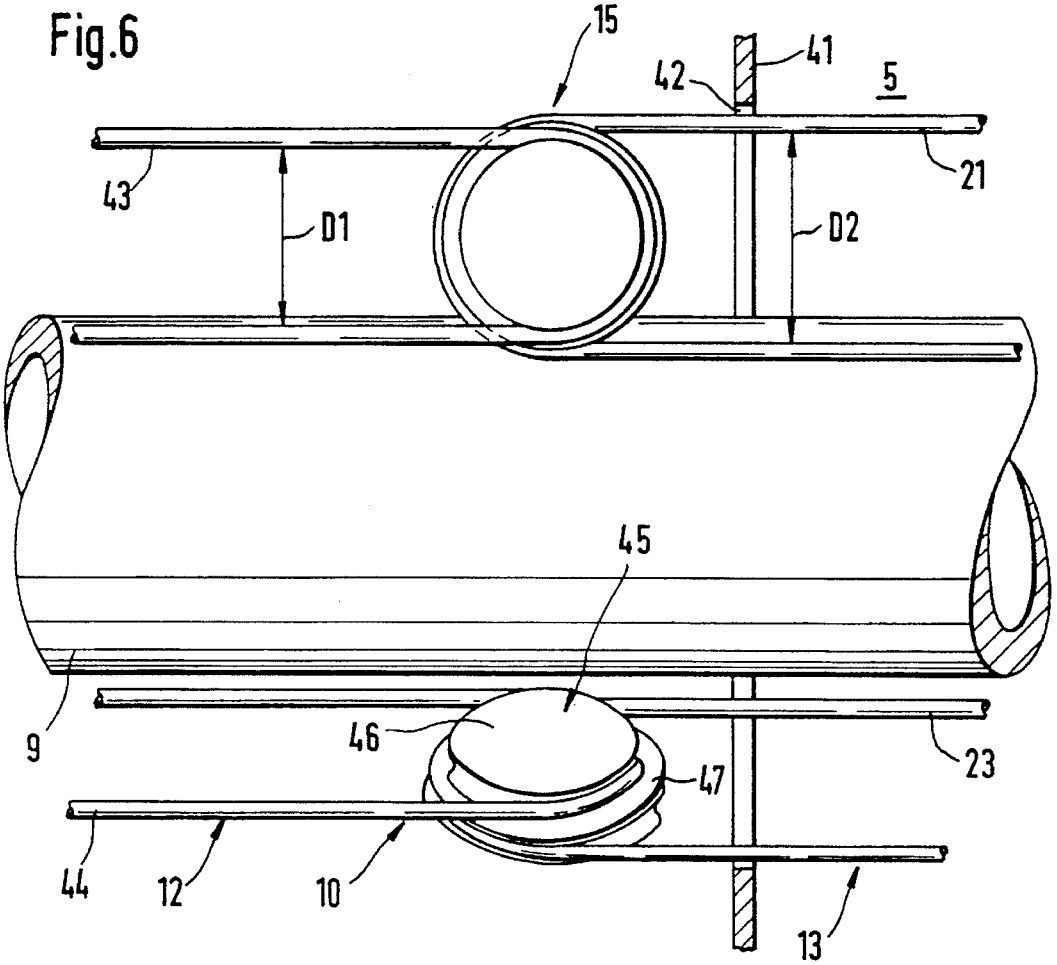
FIG. 6 shows a slightly simplified partial view similar to FIG. 3, however at the ingoing end of the heat setting chamber.

As already mentioned, it can be advantageous when heat setting particular materials to allocate a further transfer point 15 upstream of the heat setting chamber 5. Such a transfer point 15 is shown in FIG. 6, whereby however, for the sake of clarity the yarn guiding elements 35 as well as the loops 11 of the yarns 8 have been omitted. Both are, however, present.

The limiting wall 41 of the heat setting chamber 5 on the ingoing side is recognizable in FIG. 6, as is the entry opening 42 for the central mast 9 and the transport belts 10 carried by it.

The transfer point 15 separates the belt section 12 from the belt section 13 running into the heat setting chamber 5. The two single belts 21 and 23 of the belt section 13 are recognizable in FIG. 6. Only two single belts 43 and 44 of the belt section 12 arriving at the transfer point 15 are visible, although here there are of course also four single belts. As in the description for the transfer point 16, there are also four double guide pulleys 45 altogether for the transfer point 15, which each comprise two single guide pulleys 46 and 47. The inner single guide pulleys 46 are allocated to the incoming single belts 43 and 44, while the outer single guide pulleys 47 are allocated to the outgoing single belts 20 to 23.

In the cross section (not drawn) belonging to FIG. 6, the arrangement of the double guide pulleys 45 is the same as described for the transfer point 16 according to FIG. 4, with the single exception that due to the providing of longer axles of the upper double guide pulleys the trapezoidal form of the cross section resembles more a rectangular form. This will become more evident later from FIGS. 7 and 8.

While for BCF-yarns, the single guide pulleys 46,47 of the double guide pulleys 45 each have the same diameter at the transfer point 15, it can be purposeful for certain types of yarn 8 to make the diameters D1 and D2 of the single guide pulleys 46 and 47 different sizes. This means that the diameter D1 for the incoming belt section 12 is smaller than the diameter D2 for the following belt section 13. This is purposeful especially for particularly highly twisted yarns or for such double yarns which are, with respect to the ply torque, not completely evened out, as is the case for example with so-called SIRO-yarns, by which the single yarn twist and the ply torque are synchronous. The enlargement of the diameter of the single guide pulley 47 for the outgoing belt section 13 serves the purpose of slightly enlarging the cross section circumference of the already mentioned polygons of the transport belts 10 in order to avoid unwanted "kinks", by which a certain "curling up" is meant.

Figure 7:
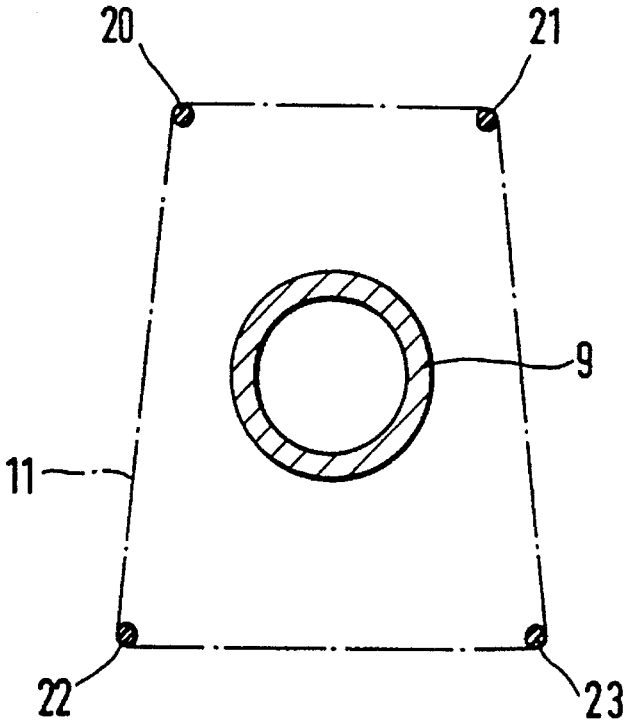
FIG. 7 shows in diagrammatic cross sectional view the transport belts arranged in a polygonal pattern in the intake area of the heat setting chamber.
Figure 8:
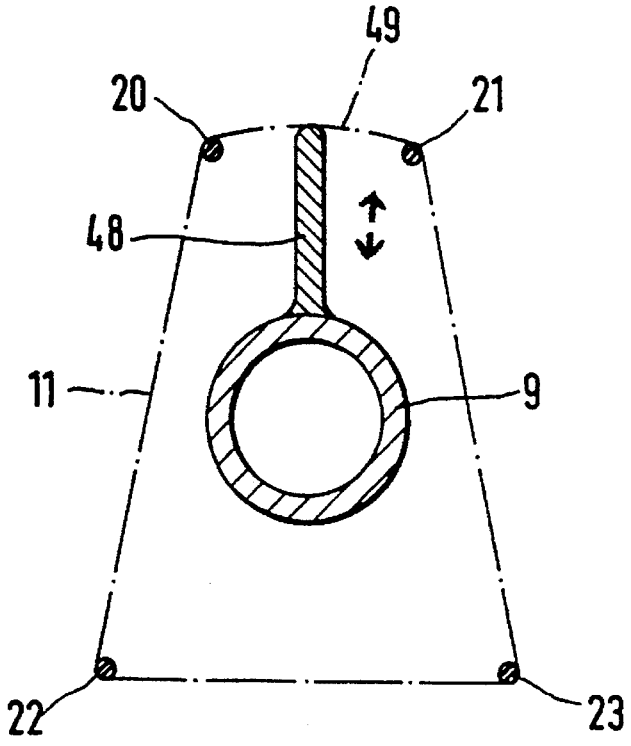
FIG. 8 shows in diagrammatic view the transport belts arranged in a polygonal pattern in the outgoing area of the heat setting chamber.

The belt section 13 inside the heat setting chamber 5 is adjustable in the cross section circumference of its polygonal pattern arranged single belts 20 to 23, which can be seen from FIGS. 7 and 8. FIG. 7 shows a cross section shortly after the entry of the transport belts 10 into the heat setting chamber 5; FIG. 8 shows a cross section shortly before the transport belts 10 leave the heat setting chamber 5.

As can be seen from FIG. 7, the single belts 20 to 23 as viewed in cross section through the central mast 9 - are arranged in approximate rectangular form, while in a later state according to FIG. 8 they have more an approximate trapezoidal form, whereby the upper edge is shorter than the lower one. In order to prevent the upper loop piece 49 from hanging down, a longitudinal rail 48 of a certain length can be provided above the central mast 9, which longitudinal rail supports the loop piece 49 from below. In a variation of FIG. 8, a longitudinal rail 48, vertically adjustable in its position (schematically indicated by arrows), can be provided to adapt to the differing shrinking properties of various fibre material. It should be pointed out here that the returning ends of the transport belts 10 are not shown in FIGS. 7 and 8, as they do not carry any loops 11 of the yarns 8.

Figure 9:
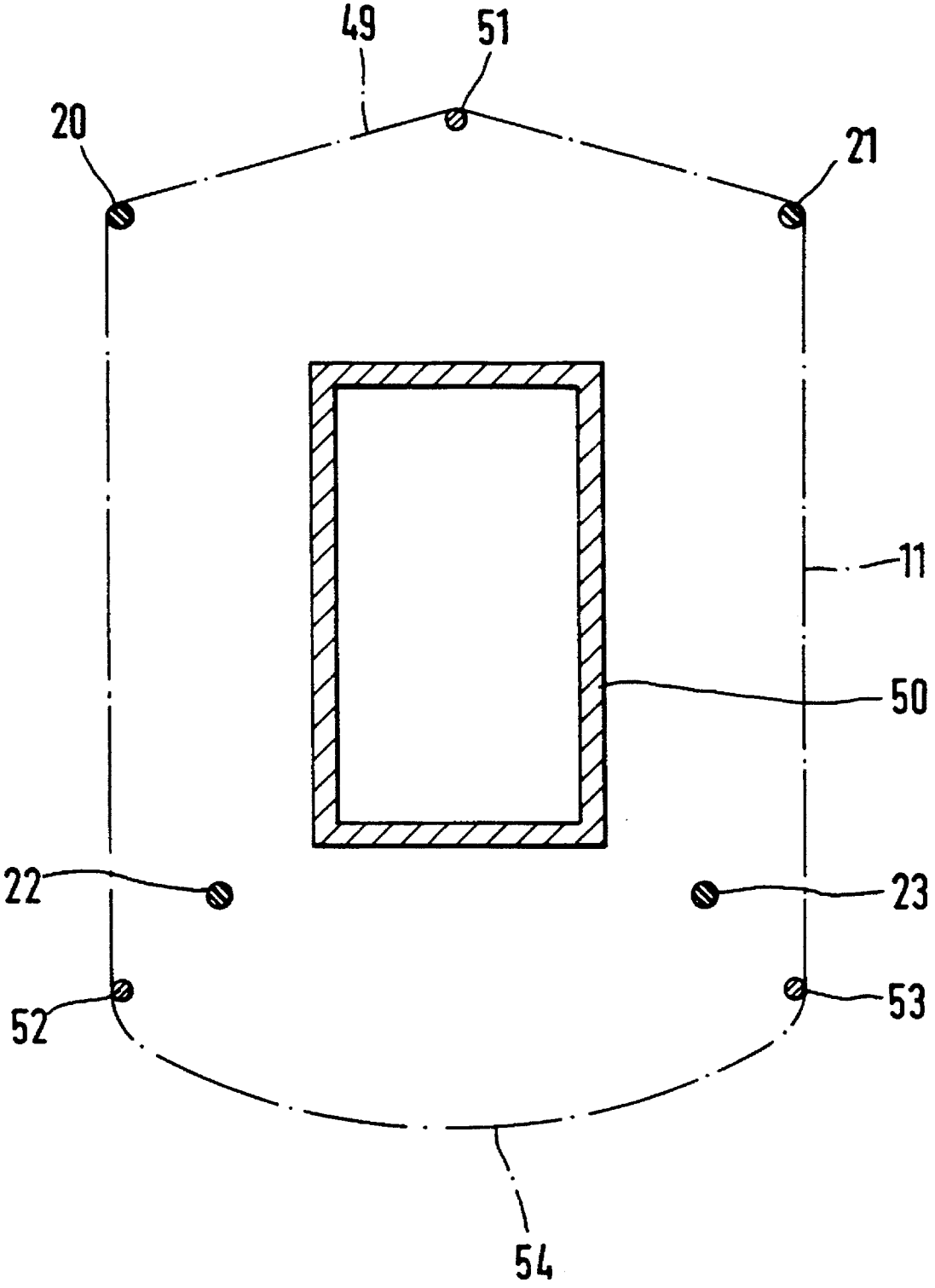
FIG. 9 shows the arrangement of the transport belts inside the heat setting chamber.

FIG. 9 shows a variation which is used preferably inside the heat setting chamber 5: In order that the shrinking of the yarns 8 is not hindered, the loops 11 of the yarns 8 lie only on the two upper single belts 20 and 21. The lower single belts 22 and 23 on the other hand are deflected so far to the inside by guiding elements (not shown) that they are not touched by the loops 11. The loops 54 hanging freely downwards as a result of this are stretched somewhat by tension wires 52 and 53. Instead of the longitudinal rail 48 of FIG. 8, the embodiment in FIG. 9 is provided with a tension wire 51 which prevents the upper loop piece 49 from hanging down.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An arrangement for continuous heat setting of yarns, comprising:

a heat setting chamber supplied with superheated steam, a central mast extending through at least a portion of the heat setting chamber, a plurality of circulating transport belts carried by the central mast, said plurality of transport belts exhibiting yarn support runs which extend longitudinally of the central mast and which are arranged such that they form corners of a polygonal form, a belt drive for driving the transport belts, and a yarn winding device for winding yarn in controlled loops around the central mast and the transport belts, wherein the transport belts are subdivided at transfer points into a plurality of longitudinally consecutively arranged endless belt sections, said transfer points being disposed outside the heat setting chamber, and, wherein yarn guiding elements are provided at the transfer points.

2. An arrangement for continuous heat setting of yarns, comprising:

a heat setting chamber supplied with superheated steam, a central mast extending through the heat setting chamber, a plurality of circulating transport belts carried by the central mast, said plurality of transport belts exhibiting yarn support runs which extend longitudinally of the central mast and which are arranged such that they form corners of a polygonal form, a belt drive for driving the transport belts, and a yarn winding device for winding yarn in controlled loops around the central mast and the transport belts, wherein the transport belts are subdivided at transfer points each into at least two longitudinally consecutively arranged endless belt sections, one of said at least two belt sections being arranged outside the heat setting chamber, and the other being arranged predominantly inside the heat setting chamber, wherein said transfer points are arranged outside, but adjacent the heat setting chamber.

3. An arrangement according to claim 2, wherein said transfer points are arranged directly downstream of the heat setting chamber.

4. An arrangement according to claim 3, wherein further points are arranged directly upstream of the heat setting chamber.

5. An arrangement according to claim 2, wherein rubber-coated double guide pulleys for the belt sections are provided at the transfer points.

6. An arrangement according to claim 5, wherein the guide pulley section of each double guide pulley which is closest to facing the central mast is allocated to each following belt section.

7. An arrangement according to claim 6, wherein the belt sections have different-sized diameters at the transfer point upstream of the heat setting chamber.

8. An arrangement according to claim 2, wherein one of the transport belt sections which travel through the heat setting chamber are configured such that least 85% of their total travel path is within the heat setting chamber.

9. An arrangement according to claim wherein the transport belts are wire cords.

10. An arrangement, for continuous heat setting yarns, comprising:

a heat setting chamber supplied with superheated steam, a central mast extending through at least a portion of the heat setting chamber, a plurality of circulating transport belts carried by the central mast, said .plurality of transport belts exhibiting..yarn support runs which extend longitudinally of the central mast and which are arranged such that they form corners of a polygonal form., a belt drive for driving the transport belts, and a yarn winding device for winding yarn in controlled loops around the central mast and the transport belts, wherein the transport belts are subdivided at transfer points into a plurality of longitudinally consecutively arranged endless belt sections, said transfer points being disposed outside the heat setting chamber, wherein double guide pulleys for the belt sections are provided at the transfer points, and wherein the guide pulley section of each double guide pulley which is closest to facing the central mast is allocated to each following belt section.

11. An arrangement according to claim 10, wherein the belt sections have different-sized diameters at the transfer point upstream of the heat setting chamber.

12. An arrangement according to claim 10, wherein said double guide pulleys are rubber-coated.

13. An arrangement according to claim 12, wherein the cross sectional circumference of the polygonal transport belt form is adjustable inside the heat setting chamber.

14. An arrangement according to claim 13, wherein tension means in the form of a longitudinal rail are provided to support an upper yarn loop piece wrapped around the cross sectional circumference of the polygonal transport belt form.

15. An arrangement according to claim 13, wherein the yarn loops are transported only by two upper transport belts when traveling inside the heat setting chamber.

16. An arrangement according to claim 15, wherein yarn loops which hang down freely are guided by guides when traveling inside the heat setting chamber.

17. An arrangement according to claim 16, wherein said guides are tension wires.

18. An arrangement according to claim 12, wherein said transport belt sections are configured to be non-rotatable about their respective longitudinal extent.

19. An arrangement according to claim 12, wherein one of the transport belt sections which travel through the heat setting chamber are configured such that least 85% of their total travel path is within the heat setting chamber.

20. An arrangement according to claim 1, wherein rubber-coated double guide pulleys for the belt sections are provided at the transfer points.

* * * * *